US005587634A

United States Patent [19]

Desai et al.

[11] Patent Number: 5,587,634

[45] Date of Patent: Dec. 24, 1996

[54] HUMAN BODY ACTUATED CONTROL APPARATUS AND SYSTEM FOR COMMERCIAL SEWING MACHINES

[75] Inventors: Dhimat R. Desai, South Barrington; Louis C. Tayse, Hinsdale; Richard W. Gideon, Schaumburg, all of Ill.

[73] Assignee: ARA Electronics Corp., Elmhurst, Ill.

[21] Appl. No.: 346,482

[22] Filed: Nov. 29, 1994

[51] Int. Cl.[6] ..... D05B 69/06

[52] U.S. Cl. ..... 318/257; 318/551; 74/515 R

[58] Field of Search ..... 74/515 R, 515 E; 318/551, 256, 257, 640, 646; 112/217.1–217.4

[56] References Cited

U.S. PATENT DOCUMENTS

| | | | |
|---|---|---|---|
| 1,419,723 | 6/1922 | Durkee | 318/551 |
| 1,926,872 | 9/1933 | Johnson | 74/515 R |
| 2,543,812 | 3/1951 | Sporklin | 318/551 |
| 2,654,206 | 10/1953 | Dobrowski | 74/515 R |
| 2,882,847 | 4/1959 | Winz | 318/551 |
| 2,950,890 | 8/1960 | Hough, Jr. | 74/515 R |
| 2,952,164 | 9/1960 | Hofgesang | 318/551 |
| 4,037,491 | 7/1977 | Newbold . | |
| 4,067,276 | 1/1978 | Mohilo et al. . | |
| 4,139,808 | 2/1979 | Matsumura . | |
| 4,161,921 | 7/1979 | Nishida et al. . | |
| 4,324,309 | 4/1982 | Ginley | 180/316 |
| 4,354,071 | 10/1982 | Pietschmann . | |
| 4,386,301 | 5/1983 | Neki et al. . | |
| 4,426,947 | 1/1984 | Marshall . | |
| 4,499,449 | 2/1985 | Shinozaki et al. . | |
| 4,501,210 | 2/1985 | Hanyu et al. . | |
| 4,507,596 | 3/1985 | Angersbach et al. | 318/640 |
| 4,517,909 | 5/1985 | Neki et al. . | |
| 4,556,001 | 12/1985 | Neki et al. . | |
| 4,563,964 | 1/1986 | Sjodia . | |
| 4,583,474 | 4/1986 | Tysinger | 112/217.3 |
| 4,586,398 | 5/1986 | Yindra . | |
| 4,602,581 | 7/1986 | Neki et al. . | |
| 4,691,588 | 9/1987 | Kumatani et al. . | |
| 4,983,901 | 1/1991 | Lehmer . | |
| 5,133,225 | 7/1992 | Lundberg et al. . | |
| 5,208,520 | 5/1993 | Sawato et al. . | |
| 5,214,360 | 5/1993 | Gonser et al. . | |
| 5,227,706 | 7/1993 | Erikson . | |
| 5,233,278 | 8/1993 | Carter | 318/551 |
| 5,253,545 | 10/1993 | Barrons et al. . | |
| 5,340,953 | 8/1994 | Krebs et al. . | |
| 5,351,571 | 10/1994 | Johnson . | |

FOREIGN PATENT DOCUMENTS

9314892 U 12/1993 Germany .

*Primary Examiner*—Brian Sircus
*Attorney, Agent, or Firm*—Charles F. Meroni, Jr.

[57] ABSTRACT

An electronic control system and apparatus is provided for controlling the operation of an industrial machine, such as a sewing machine. A body actuated apparatus is mounted in a spaced apart relationship from ground level and in approximate adjacency to the sewing machine. The body actuated apparatus has an elongated control bar pivotally mounted to the body actuated apparatus along a longitudinal axis of the elongated control bar for actuation of a force sensor when a body of an operator pressingly engages the elongated control bar in a direction towards the sewing machine. Electronic means for controlling the speed of a motor of the sewing machine is provided which includes monitoring means for monitoring sensor input produced by the force sensor, and controlling means responsive to the monitoring means for varying the speed of the motor of the industrial machine by outputting control signals to the motor. Jumper means are provided for programming a particular configuration of input and output requirements responsive to different types of sewing machine motors.

56 Claims, 9 Drawing Sheets

LOGIC DRIVERS U7 ULN2003
GND COM
R36 4.7K
R37 4.7K
R38 4.7K
R39 4.7K
COMMON
DB1 DB25
P1
P2
P3
COMMON
ANALOG SPEED
P4
X
VCC
+5
+30
U5 27256
REV A8
ADC0805 U4
VIN(-)
VIN(+)
A-GND
Vref 2
CLK-R
CLK-IN
VCC REF
IsbDB0
MsbDB7
INTR
CS
RD
WR
R19 1K
R50 1.5K
C14 .001
R52 15K
U3=D 4066
U6=B 4093
POWER ON RESET
R51 100K
C18 1uf
U9 LM10
R40 4.7K
R41 4.7K
R43, 3.3K
R42, 4.7K Fig. 10
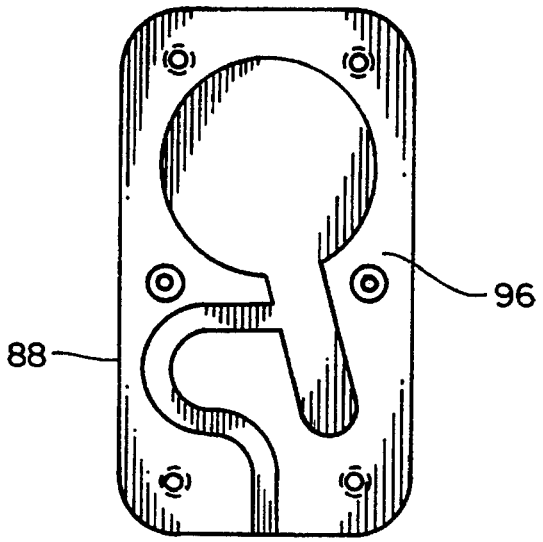
Fig. 11
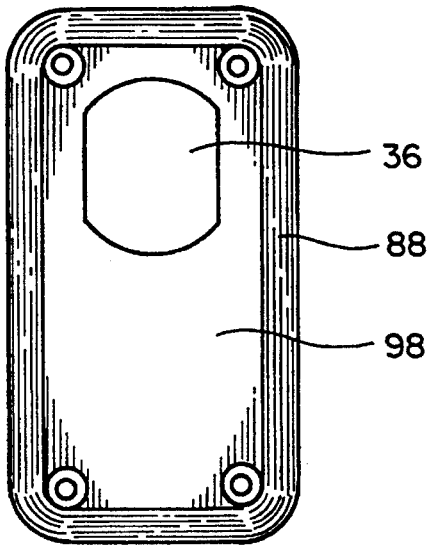
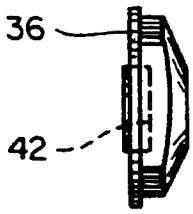
Fig. 12

HUMAN BODY ACTUATED CONTROL APPARATUS AND SYSTEM FOR COMMERCIAL SEWING MACHINES

BACKGROUND OF THE INVENTION

1. Field of the Invention

The present invention relates generally to an industrial machine control apparatus and control system. More particularly, the invention pertains to a human body actuated control apparatus and system for use with commercial sewing machines.

2. Description of the Prior Art

Manufacturing industries, such as the sewing industry, have recognized that the operation of equipment is ergonomically improved if the operator is standing rather than sitting. The upright standing position of a worker has been shown to reduce fatigue as well as reduce repetitive stress injuries.

Today, stand up operations are primarily accomplished with the use of foot operated pedals located on the floor. Various types of foot operated pedals for use in a stand up operation are known in the art. Some foot pedals utilize a single pedal having a center pivot for forward or reverse actuation. Other designs have been proposed utilizing multiple foot pedals to obtain different functions such as low speed, high speed, foot lift, and thread trim and needle up.

However, all floor located pedals suffer from a common problem. The operator is required to stand on one foot and operate the pedal with the other foot. Almost all the weight of the operator must be applied to one foot so that the second foot is free to actuate the foot pedal or pedals. This uneven distribution of weight becomes tiring for an operator and often leads to back pain.

A second problem with floor pedals involves the floor pedals position. The placement or positioning of floor pedal is generally in a fairly precise location. Therefore the operator must stand in one position or must look for the foot pedal if he or she moves from that position.

Thus there is a need for an apparatus that would allow an operator to control an industrial type of machine, such as a commercial sewing machine, while standing with both feet on the floor with equal weight distribution and requiring little effort to operate the machine. Furthermore, there is a need for a device to be operated without the operator having to look for the controls while at the same time would allow the operator a larger range of standing locations or postures.

As will be described in greater detail hereinafter, the control apparatus and system of the present invention differs from those previously proposed.

SUMMARY OF THE INVENTION

Accordingly, it is an object of this invention to provide a human body actuated control apparatus and system for operation of an industrial machine.

Another object of this invention is to provide a control system and apparatus for operating a sewing machine which allow the operator to control the machine with effortless, stress-free body motion while standing with both feet solidly on the floor.

Still another object of this invention is to provide a control system and apparatus that allows an operator to operate a sewing machine without having to look for the controls and provides the operator with a range of postures or standing locations.

Yet another object of this invention is to provide an electronic control system capable of being pre-programmed and easily adapted to work with different motors and interfacing configurations.

Yet still another object of this invention is to provide a control system and apparatus having both body actuated controls and foot pedals allowing for both standup or sit-down operation of a sewing machine so that an operator has a full range of ergonomically improved positions to choose from.

To achieve the foregoing and other objectives, and in accordance with the purposes of the present invention a control apparatus for controlling the operation of a sewing machine with an upright body portion of a human body is provided. The apparatus comprises a body actuated apparatus mounted in a spaced apart relationship from ground level and in approximate adjacency to the sewing machine. The body actuated apparatus having an elongated control bar pivotally mounted to the body actuated apparatus along a longitudinal axis of the elongated control bar for actuation of a force sensor when a front portion of the upright body portion of an operator pressingly engages the control bar in a direction towards the sewing machine. The body actuated apparatus having an elongated function bar pivotally mounted to the body actuated apparatus along longitudinal axis of the elongated function bar for actuation of a second force sensor when a side portion of the upright body portion of the operator pressingly engages the elongated function bar.

In accordance with an aspect of the invention, the body actuated apparatus comprises an elongated housing, an elongated control bar, means for pivotally mounting the elongated control bar to the elongated housing and biasing means operatively positioned between the elongated housing and the elongated control bar for urging the elongated control bar in a first direction. A force sensor is operatively positioned between the elongated housing and the elongated control bar. Sensor actuator means operatively positioned relative to the force sensor are provided for co-action with the force sensor when the body of an operator pressingly engages the elongated control bar in a second direction.

In accordance with another aspect of the invention, an electronic control system for controlling the operation of an industrial machine is provided. The system comprises a body actuated apparatus mounted in a spaced apart relationship from ground level and in approximate adjacency to the industrial machine. The body actuated apparatus having an elongated control bar pivotally mounted to the body actuated apparatus along a longitudinal axis of the elongated control bar for actuation of a force sensor when a body of an operator pressingly engages the elongated control bar in a direction towards the industrial machine. Electronic means are provided for controlling the speed of a motor of the industrial machine which include monitoring means for monitoring sensor input produced by the force sensor, and .controlling means responsive to the monitoring means for varying the speed of the motor of the industrial machine by outputting control signals to the motor.

In accordance with yet another aspect of the invention, the electronic means includes jumper means for programming a particular configuration of input and output requirements responsive to the industrial machine, and coding means electronically stored and responsive to the jumper means for automatic configuration of the controlling means to provide control signals responsive to the input and output requirements of the industrial machine.

Other objects, features and advantages of the invention will become more readily apparent upon reference to the following description when taken in conjunction with the accompanying drawings, which drawings illustrate several embodiments of the invention.

BRIEF DESCRIPTION OF THE DRAWINGS

In the drawings:

FIG. 8 is a flowchart showing program steps to automatically configure the control system to operate with a specific type of motor in accordance with the present invention.

FIG. 9 is an electrical schematic drawing illustrating a preferred manner in which the electronic control system of the present invention can be implemented.

FIG. 10 is a bottom elevation view of a foot pedal of the present invention;

FIG. 11 is a top elevation view of a foot pedal of the present invention; and FIG. 12 is a side elevation view of an actuator button of the foot pedal of the present invention.

DETAILED DESCRIPTION OF THE PREFERRED EMBODIMENT

Figure 1:
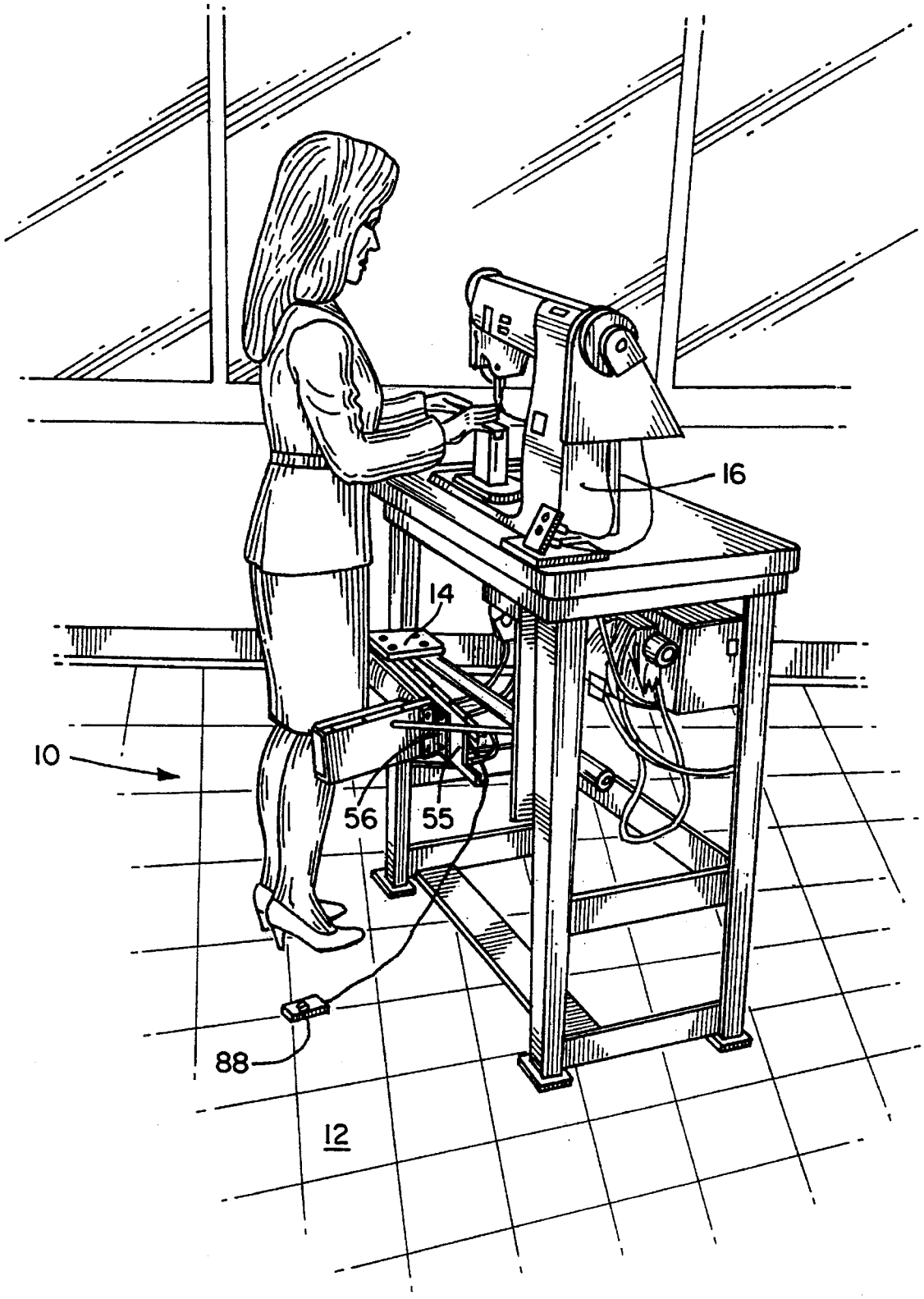
FIG. 1 is a perspective view of the present invention mounted to a commercial sewing machine.

Referring now to the drawings, an above ground level human body actuated control apparatus and system for use with an industrial machine is shown generally in FIG. 1 by the numeral 10. The body actuated apparatus 10 is mounted in a spaced apart relationship from ground level 12 with a mounting assembly 14. The apparatus 10 is in approximate adjacency to the industrial machine, such as sewing machine 16. It can be appreciated that the apparatus 10 can be used with different types of industrial machines.

Figure 4:
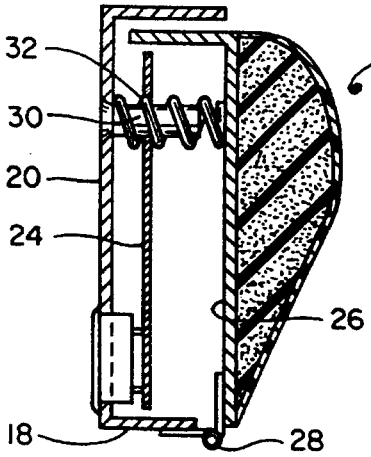
FIG. 4 is a sectional view of the present invention taken along line A—A of FIG. 2.

The apparatus 10 includes an elongated housing 18. The elongated housing 18 includes a base 20, preferably formed from a metal C-shaped channel having threaded stand-offs 22 staked on for mounting a circuit board 24. An elongated control bar 26 is provided along with means for pivotally mounting the elongated control bar 26 to the elongated housing 18 along a longitudinal axis of the elongated control bar 26. The elongated bar 26 is preferably formed by an L-shaped metal channel and is approximately 16 inches long. The means for pivotally mounting the elongated control bar 26 to the elongated housing 18 for generally horizontal movement of the control bar 26 relative to the housing 18 includes a pair of hinges 28 mounted at either ends of the elongated control bar 26, as best illustrated in FIG. 4. It is to be understood that other types of pivotally mounting could equally be used. As shown in FIG. 1, the control bar 26 is sized and configured for horizontally extending across an upright body portion of an operator.

Figure 5:
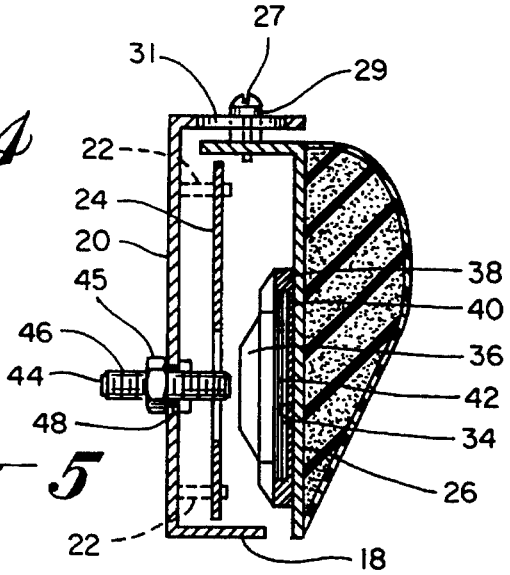
FIG. 5 is a sectional view of the present invention taken along line B—B of FIG. 2.

Referring now to FIG. 4, biasing means operatively positioned between the elongated housing 18 and the elongated control bar 26 are provided for urging the elongated control bar 26 in a first direction. The biasing means includes two threaded spacers 30 connected to the base 20. A pair of springs 32 are provided with each spring being placed on a threaded spacer 30 for keeping the elongated control bar 26 pressed away from the elongated housing 18. To keep the elongated control bar 26 from disengaging from the elongated housing 18, a screw stop 27 is inserted through a screw stop spacer 29 and is mounted to the elongated control bar 26, as shown in FIG. 5. The screw stop 27 is movable within screw stop slot 31 of the elongated housing 18.

A force sensor 34 is operatively positioned between the elongated housing 18 and the elongated control bar 26, as shown in FIG. 5. The sensor 34 is a flat two terminal device of conventional design whose electrical resistance decreases as the force or pressure applied to its active area increases. The resistance of the sensor 34 is high, for example over 100,000 ohms, when very little or no force is applied. The resistance decreases in a non-linear fashion with increasing force.

A double D button 36 is mounted above the sensor 34 by mounting structure 38 which engages a flange 40 of the button 36. The button has a pliable rubber circular member 42 which rests against the active area of the sensor 34. A sensor actuator means is provided operatively positioned relative to the sensor 34 for co-action with the sensor 34 when the body of an operator pressingly engages the elongated control bar 26 in a second direction. The portion of body used to press against the elongated control bar 26 is preferably a center body portion or upper body portion. Preferably, sensor actuator means includes an adjustable actuator 44 having external threads 46 for threaded engagement with a threaded aperture 48 of the elongated housing 18 to provide means for adjustably mounting the actuator 44 so that the spaced apart relationship between the actuator 44 and the sensor 34 can be varied. A jam nut 45 is provided for holding the actuator in a secured position.

Figure 2:
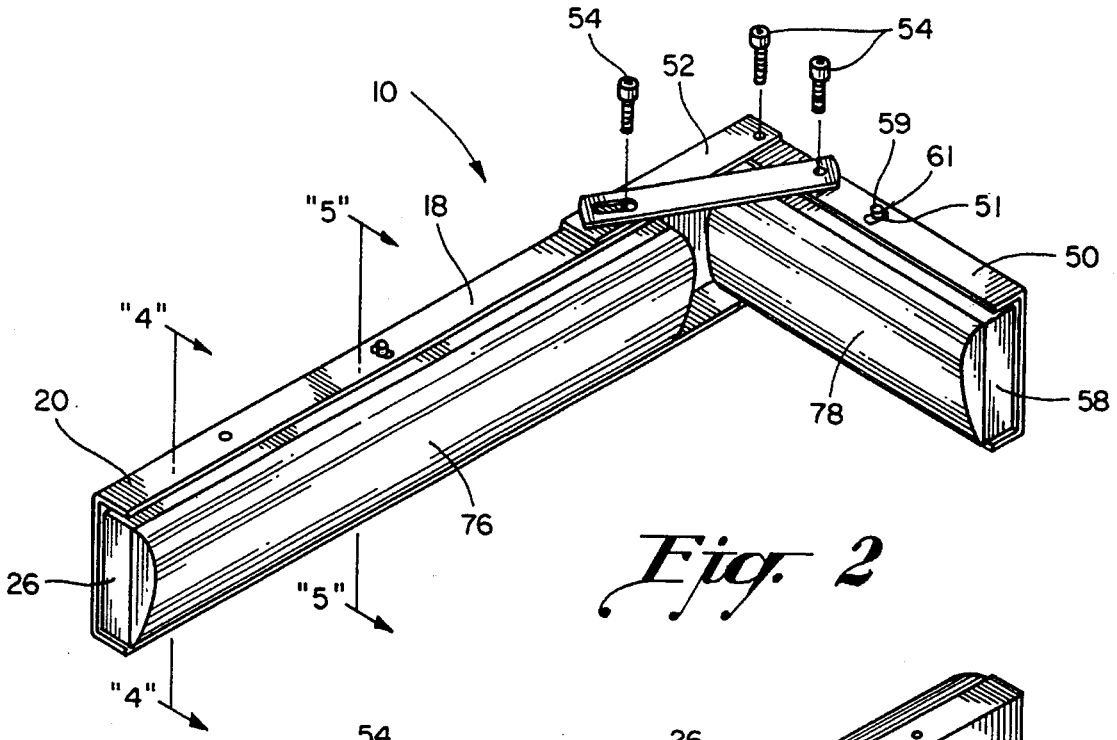
FIG. 2 is a front perspective view of the human body actuated control apparatus of the present invention.

Referring now to FIG .2, a second elongated housing 50 is provided along with pivoting means for pivotally connecting the second elongated housing 50 to the elongated housing 18 for adjustable positioning the elongated second housing 50 relative to the elongated housing 18. In a preferred embodiment shown in FIGS. 2 and 3, a connecting C-shaped channel 52 is mounted between the elongated housing 18 and second elongated housing 50 with screws 54. In an alternative embodiment shown in FIG. 1, the elongated housing 18 includes an extending channel member 55 connected to the base 20. A pivot hinge 56 is vertically mounted to the extending channel member 55 and to an inner side edge of the second elongated housing 50. It has been found that it is preferred if the second elongated housing 50 is pivotable approximately 0° to 90° in planar relation to the elongated control bar 26 for varied adjustment of the elongated function bar to suit the needs of operators of different physical shapes and having different postures.

An elongated function bar 58 approximately 8 inches long is provided. Means for pivotally mounting the elongated function bar 58 to the second elongated housing 50 along a longitudinal axis of the elongated function bar 58 and second biasing means operatively positioned between the second elongated housing 50 and the elongated function bar 58 for urging the elongated function bar in a third direction are provided similar that previously discussed and shown in FIGS. 4 and 5. To keep the elongated function bar 58 from disengaging from the second elongated housing 50, a second screw stop 59 is inserted through a second screw stop spacer 61 and is mounted to the elongated function bar 58, similar to that shown in FIG. 5. The second screw stop 59 is movable within screw stop slot 51 of the second elongated housing 50.

A second force sensor or reverse sensor similar to sensor 34 is operatively positioned between the second elongated housing 50 and the elongated function bar 58. A second sensor actuator means is operatively is positioned relative to the second force sensor for co-action with the second force sensor when the body of the operator pressingly engages the elongated function bar 58 in a fourth direction. Similar to that previously discussed and shown in FIG. 5, a second adjustable actuator 60 having external threads 62 for threaded engagement with a threaded aperture 64 of the second elongated housing 50 is provided. A second jam nut 66 is provided for holding the actuator 60 in a secured position.

The elongated function bar 58 can be secured in a selected pivoted position so that the elongated function bar 58 will remain in a predetermined position relative to the elongated control bar 26 when the elongated function bar 58 is pressed. In preferred embodiment best illustrated in FIG. 3, a metal adjustment bar 68 having a first end 70 and a second end 72 is provided. The first end is pivotally mounted to the second elongated housing 50 with a screw 54. The second end 72 has a slot 74 for varied adjustable mounting to the elongated housing 18 with a screw 54.

Figures 6, 7:
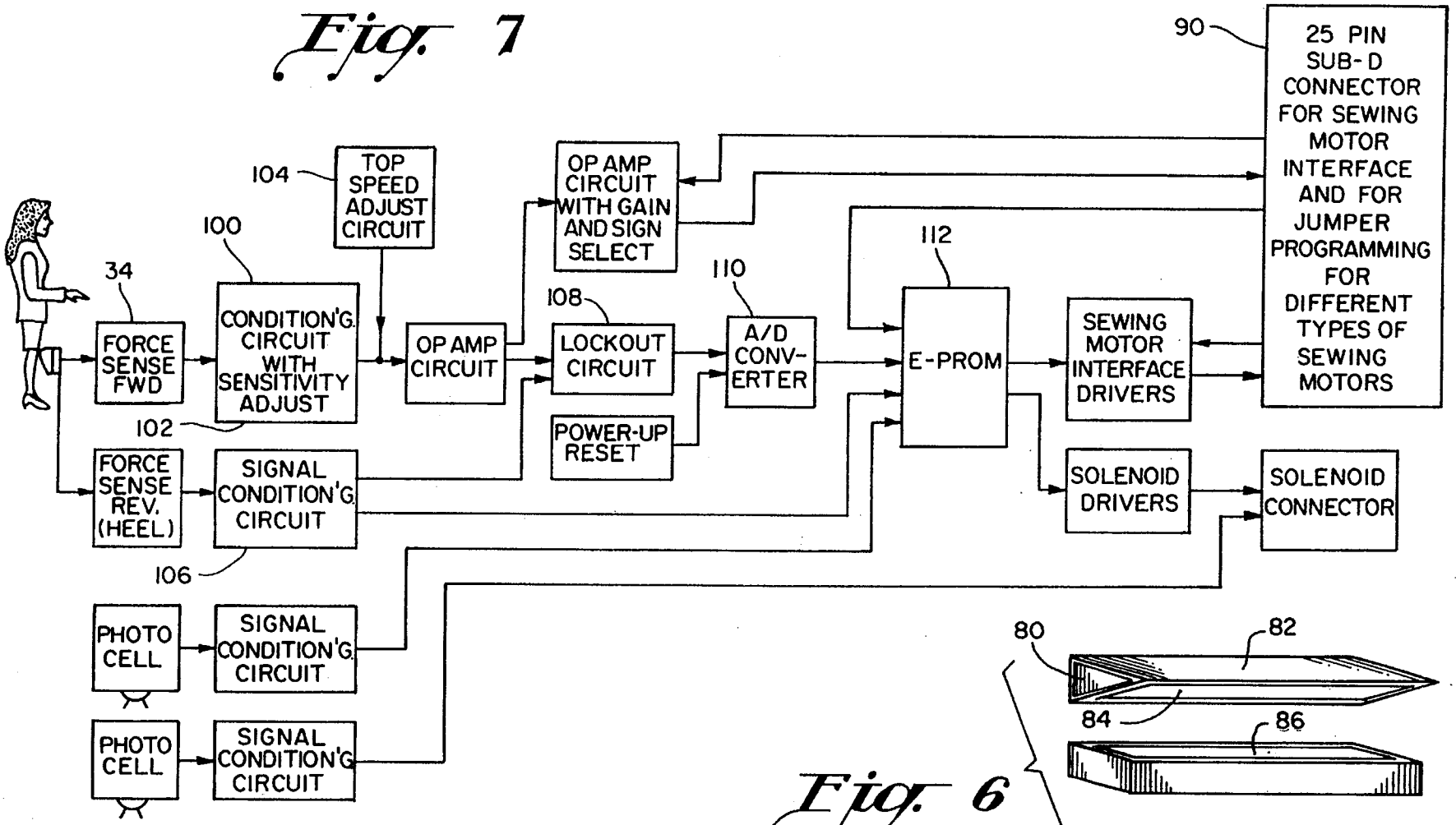
FIG. 6 is a perspective view showing a removably detachable foam pad of the present invention.
FIG. 7 is a block diagram showing the electronic control system in accordance with the present invention.

The elongated control bar 26 includes a wedge shaped control bar pad 76 mounted on a vertically disposed outer side of the elongated control bar 26 for pressingly engaging a front portion of an upright body portion of the operator when the elongated control bar is pressed. The elongated function bar 58 includes a wedge shaped function bar pad 78 mounted on an outer side of the elongated function bar 58 for pressingly engaging a side portion of an upright body portion of the operator when the elongated function bar 58 is pressed. As illustrated in FIG. 6, the wedge shaped function bar pad 78 and wedge shaped control bar pad 76 are preferably formed of a foam piece or pad 80 surrounded by a velvet like cloth 82 and are removably mounted with hook and loop fastening means, such as VELCRO. A first strip 84 of VELCRO is attached to a bottom side of the wedge shaped function bar pad 78 and wedge shaped control bar pad 76. A second mated strip 86 of VELCRO is attached to the elongated control bar 26 and elongated function bar 58 for removable attachment with the corresponding first strip 84.

The orientation of the wedge shaped function bar pad 78 and wedge shaped control bar pad 76 is such that the wider side is on the top, as shown in FIG. 1. The wedge shape, foam piece 80, and velvet like cloth 82 have been designed through extended research to assure maximum comfort of the operator and reduction of the sewing machine vibration being transferred to the operator.

Figure 3:
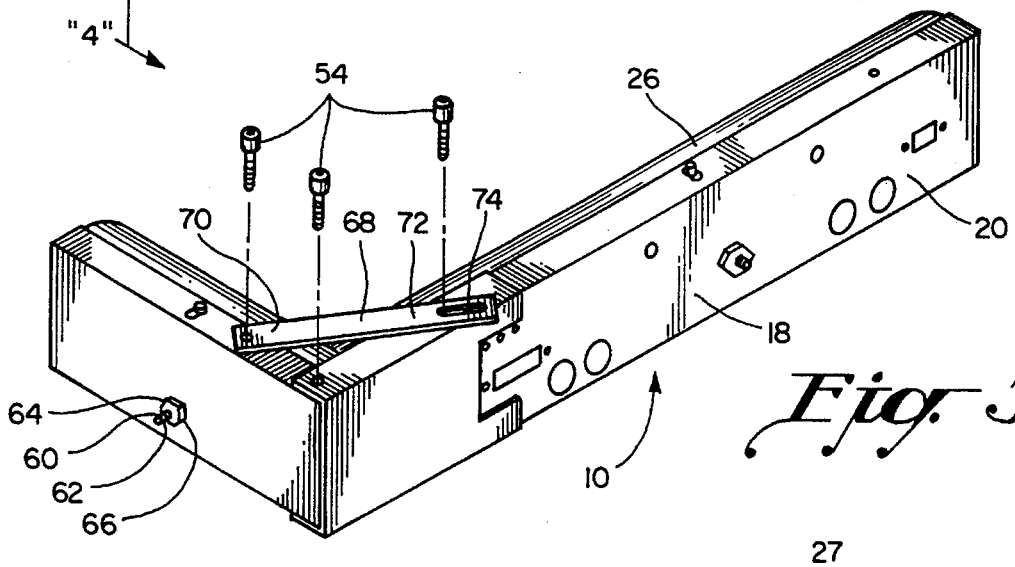
FIG. 3 is a rear perspective view of the human body actuated control apparatus of the present invention.

The circuit board 24 has circular DIN connectors mounted on the non-component side for connection to two flat foot pedals 88, and for two photocells of conventional design. The base 20 has a 25 pin subminature D connector 90 for connection to a motor of the sewing machine 16 as well as for jumper programming which is described below. A 9 pin subminature D connector is provided for connection to solenoid valves. Three potentiometers are located on the backside of the elongated housing for top speed adjustment of the motor, force adjustment of the force sensor, and a time function adjustment. These functions are described in detail below. The base 20 has openings for all of the connectors as well as for the three potentiometers, as best shown in FIG. 3.

The electronic means for controlling the speed and reverse functions of a motor of the industrial machine are carried out on the circuit board 24. The circuit board has been designed so that it can provide either sewing machine motor basic functions alone, or partially automatic functions in addition to the sew motor basic functions.

Referring now to the block diagram of FIG. 7, the operation of the electronic control system within the circuit board is shown in accordance with the present invention. It can be appreciated that the electronic control system can be electronically implemented in a number of ways. The electrical schematic drawing of FIG. 9, illustrates a preferred manner in which the electronic control system of the present invention can be implemented. The primary features of the circuitry shown in FIG. 9 are described below with the additional features being self-explanatory to one skilled in the art.

When force or pressure is applied to the body actuated apparatus 10 by the operator's legs or center body portion to the elongated control bar 18, the force is transmitted through the actuator 44 and to the force or force sensor 34 to control the forward speed of the motor. Monitoring means 100 is provided for monitoring or receiving sensor input produced by the sensor 34. The sensor 34 is connected in series with resistor R1 to form a voltage divider. The voltage generated is amplified, buffered, and conditioned via Op Amp U1:A. The potentiometer P2 allows means 102 for adjusting the sensitivity of the monitoring means so that an amount of force necessary to actuate the force sensor can be varied, by adjusting voltage at the positive input of the Op Amp.

Op Amp U1:B is connected in a voltage follower mode. Its output is dependent on the adjustment of potentiometer P3. The output of this Op Amp is connected to the output Op Amp U1:A via resistor R10 and diode D1. Output of U1:B thus reduces the voltage input to the next Op Amp U2 which reduces the maximum speed of the machine. This provides means 104 for adjusting a maximum speed of the motor attainable when the sensor input of the monitoring means signals full actuation of the sensor 34 and is controlled by a knob which is connected to the potentiometer P3 to allow an operator control of the maximum speed of the machine. This provides a training tool allowing a new operator to become accustomed to its operation. In use, it has been found that new operators were able to reach maximum production speeds within a very short amount of time.

Op Amp U2 is connected in a positive gain mode and was selected to give rail to rail output, which will be very close to either +5 V or 0 V. This is necessary to get a wider range of A/D converter input and output, as well as to achieve top speed in some electronic motors requiring analog speed input, such as sewing machines produced by Singer and Clinton.

Referring now to the function of the second force or reverse sensor with the elongated function bar, the function of this sensor is to provide three distinct outputs; no force, low force, and high force. Monitoring means 106 is provided for monitoring or receiving sensor input produced by the reverse sensor. Op Amp U1:C amplifies voltage divider output made by the sensor and resistor R5. The Op Amp stage made by U1:D provides output at a force lower than the force output to lockout sensor output produced by the forward speed control force sensor 34 when the second force sensor is even slightly activated to provide a safety mechanism. The lockout means or circuit 108 is accomplished by three analog switches U3:A, U3:B, and U3:C. Analog switch U3:C is connected in inverter format with its control input. Its control input is connected to control analog switch U3:A, and its output is connected to control Analog switch U3:B, making sure that only one will be on at a time, and that force sensor 34 output goes to the A/D converter 110 only when the second force sensor is not depressed. Additionally, output of analog switch U3:C is connected to input A8 on the EPROM 112, so that the proper program configuration within the EPROM 112 is selected to operate the forward speed control functions from sensor 34 or the heeling or reverse functions from the second pressure sensitive sensor.

Outputs of the force sensor and second pressure sensitive sensor Op Amps are selectively connected to the input of the A/D converter 110. An 8 bit A/D converter was selected for cost effectiveness and also to provide a high enough resolution. The eight outputs of the A/D converter are connected to the eight inputs of the EPROM U5 or EPROM 112. EPROM U5 has a 256K memory and was selected for its large number of input lines allowing for jumper programming at the 25 pin subminature D connector for use with many types of motors, as well as its cost effectiveness. EPROM U5 also allows for the use of photocell or other external inputs for partial automation. Additionally, EPROM U5 allows for providing either full forward speed control or providing only two speed control to satisfy preferences of different sewing operators.

The inputs A0 thru A14 of the EPROM U5 are connected as follows: A0–A7 are connected to the outputs of the A/D converter. These provide speed output if the second pressure sensitive sensor is not activated and they provide reverse function outputs if the second pressure sensitive sensor is activated; A8 selects the proper programmed outputs depending on activation of the second pressure sensitive sensor; A9–A12 are connected to the 25 pin subminature D connector via filter circuits to allow for jumper means for programming a particular configuration of input and output requirements responsive to the sewing machine from the EPROM for different motors, as well as for selecting full forward speed control versus two speed control; A13–A14 are connected to the photocell #1 circuit and its time delay function for semi-automation in a particular application. To achieve this function, photocell processing means for monitoring a photocell sensor input produced by a photocell and controlling the speed of the motor in response to the photocell sensor input is provided. The photocell processing means includes timer means for calculating a period of time delay before the controlling means should cease operation of the motor based upon corresponding photocell sensor input, as well as means for adjusting the period of time delay calculated by the timer means with the use of potentiometer P1, as shown in FIG. 9.

Figure 8A:
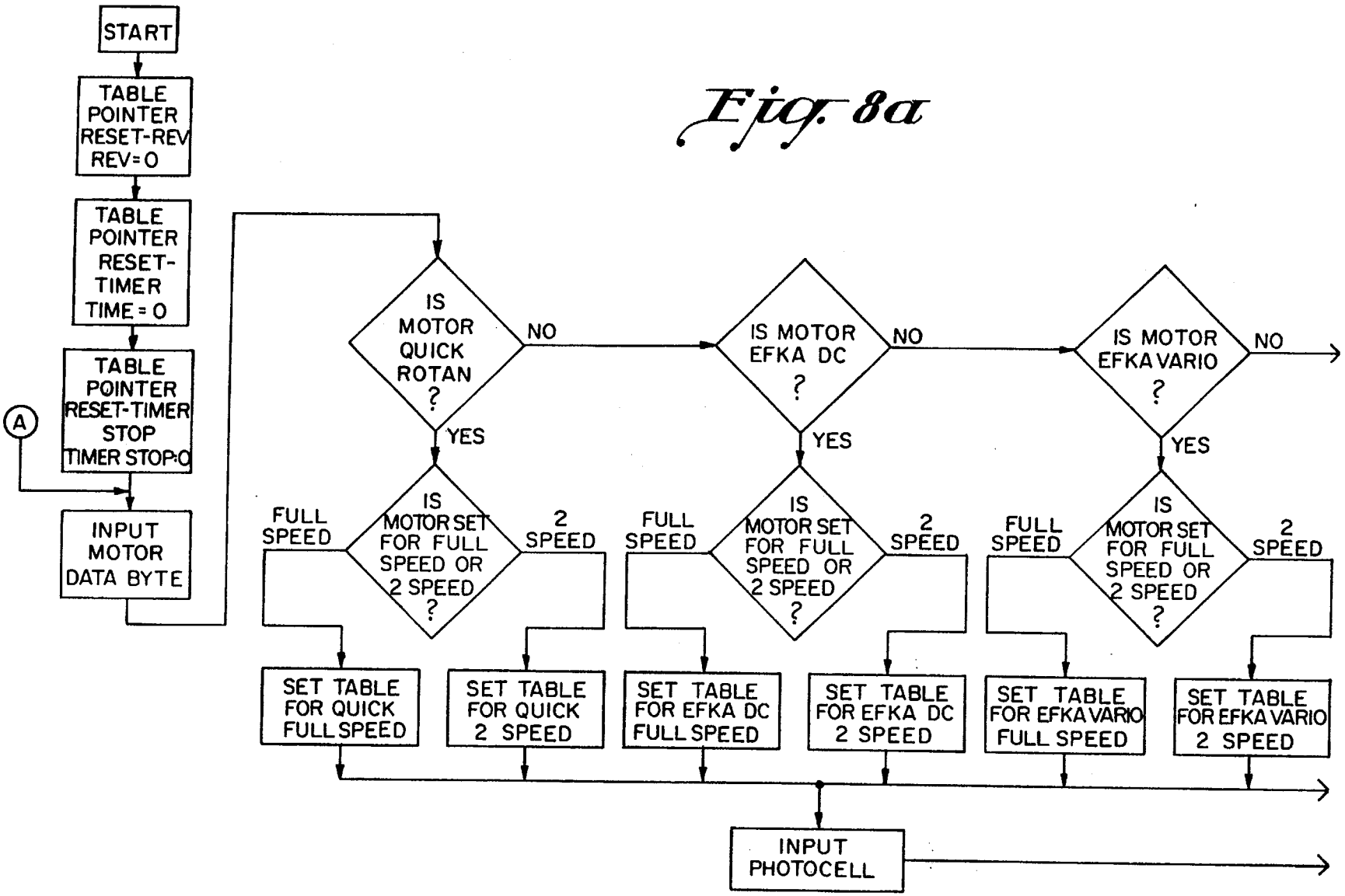
FIGS. 8*a* and 8*b* comprise the entirety of FIG. 8.
Figure 8B:
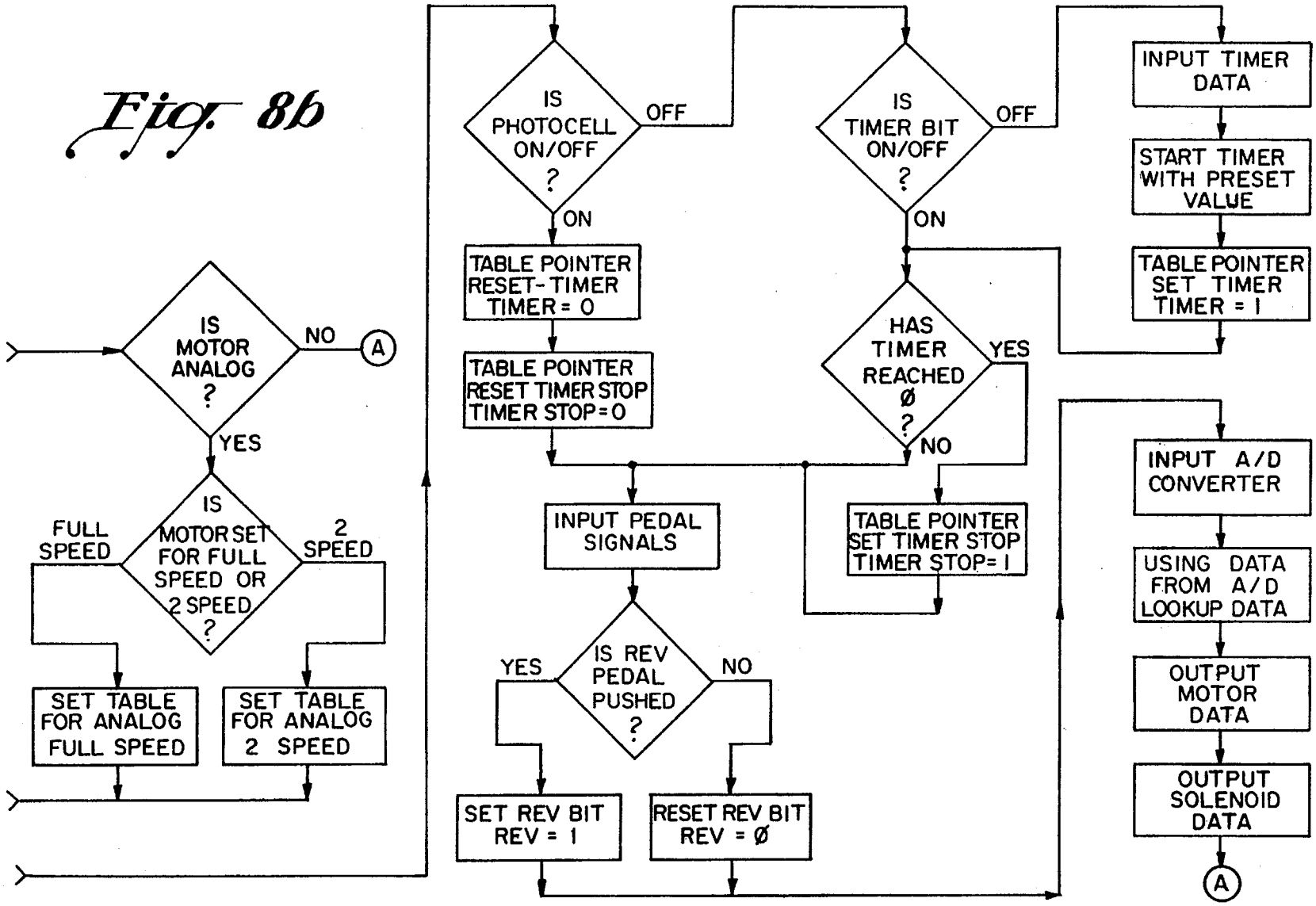
Figures 9A, 9B:
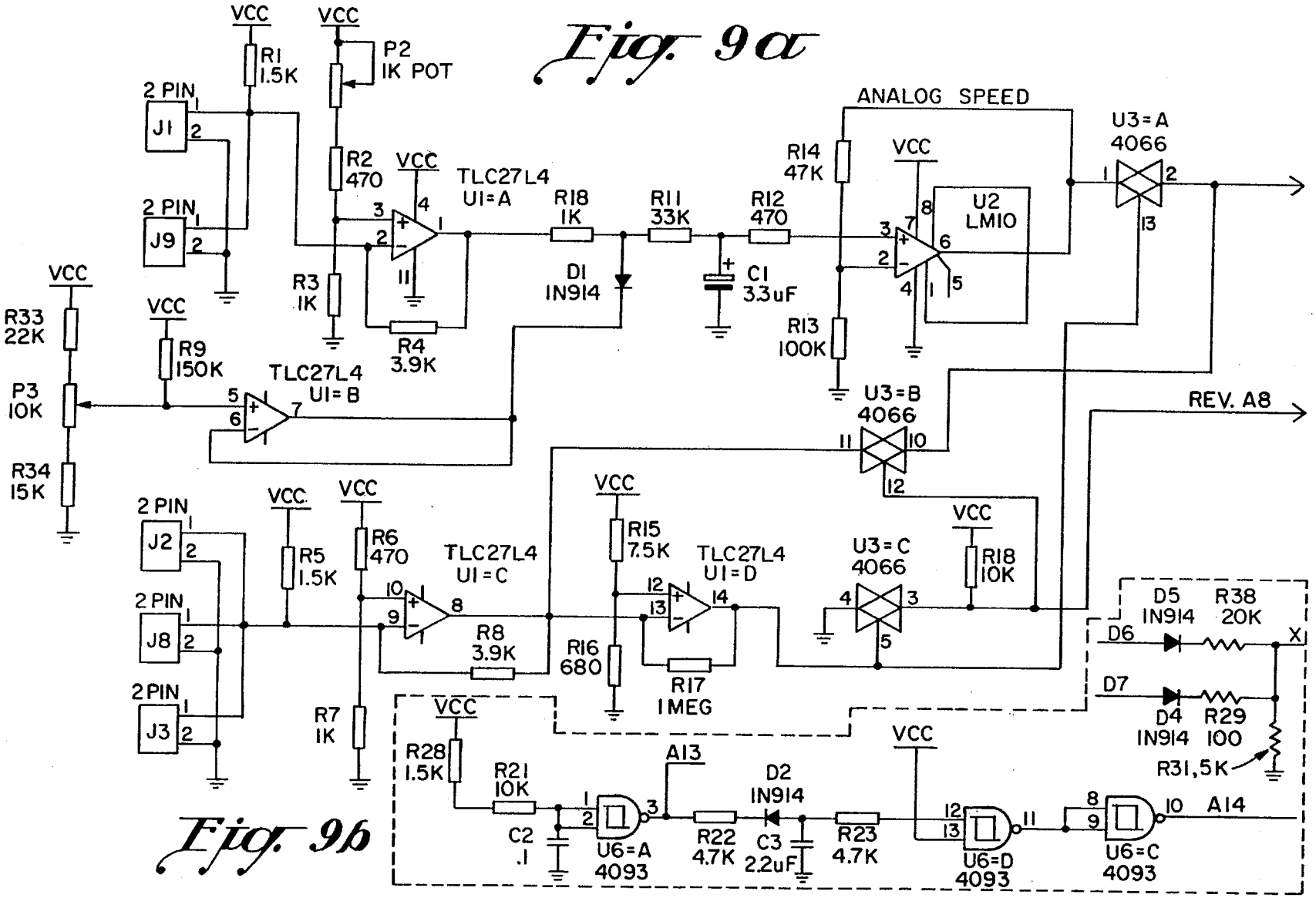
FIGS. 9*a*–9*k* comprise the entirety of FIG. 9.
Figures 9C, 9D, 9E:
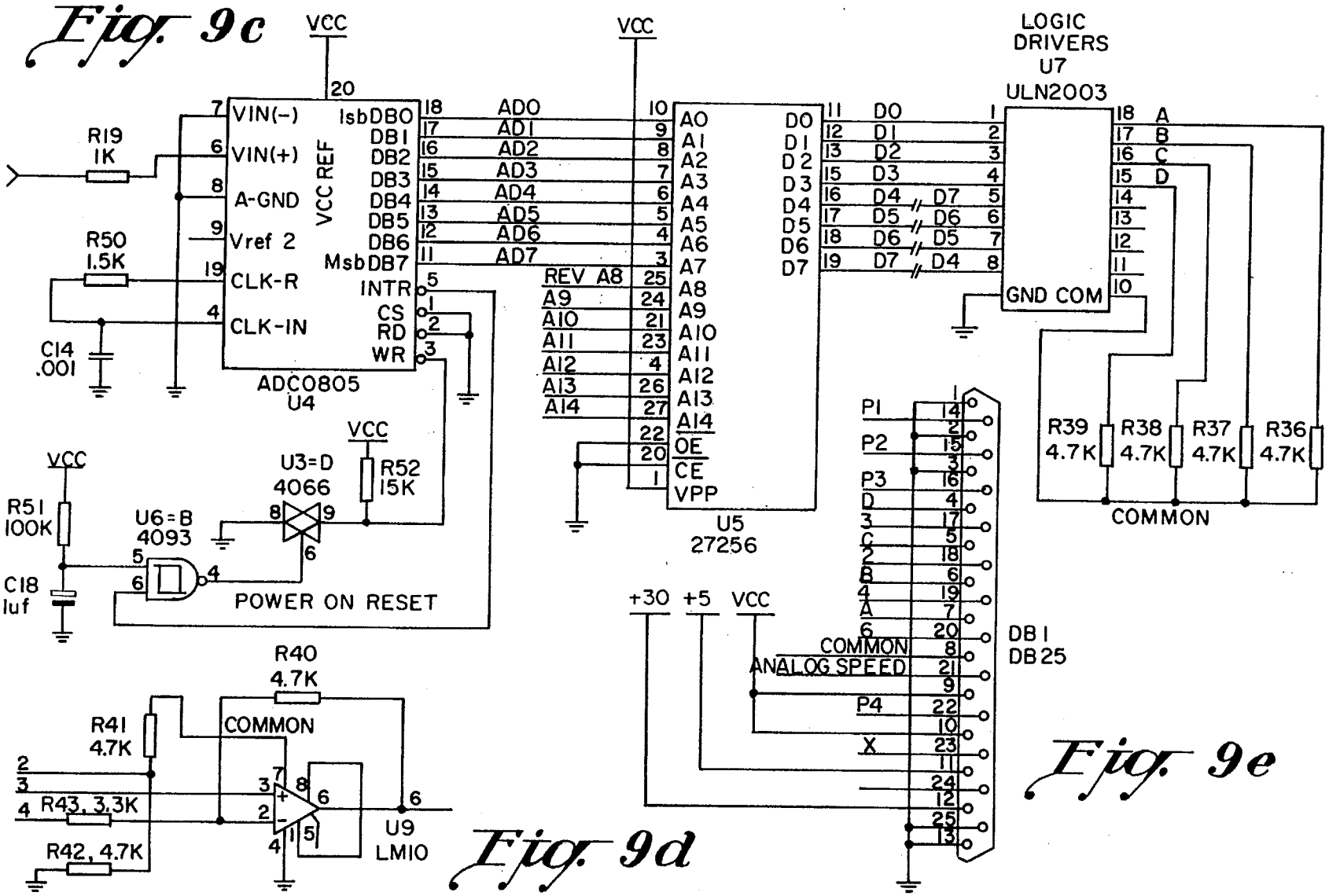
Figure 9F:
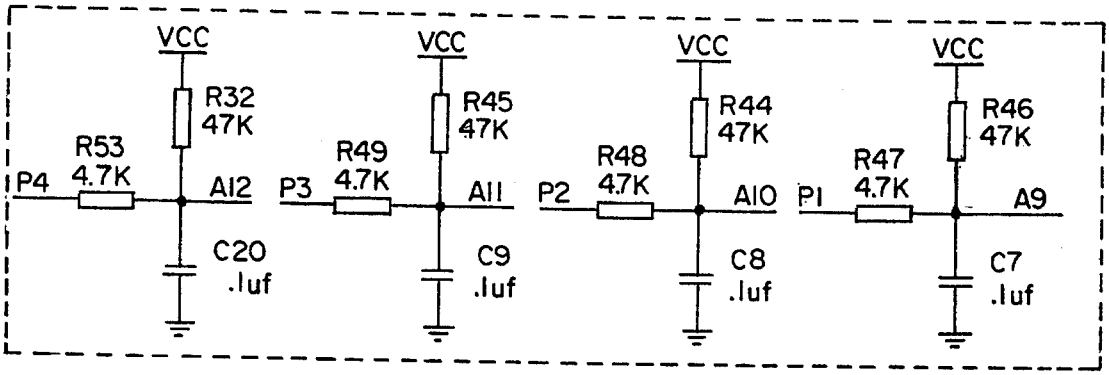
Figure 9G:
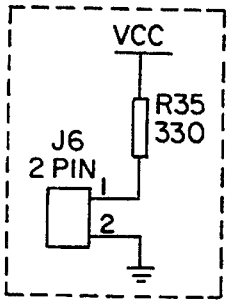
Figure 9H:
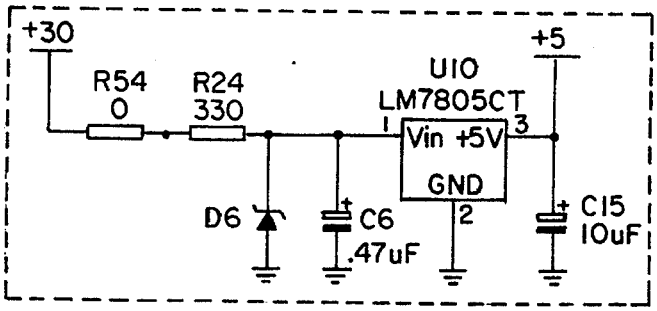
Figure 9I:
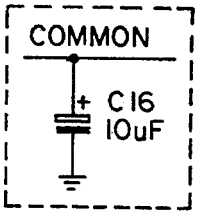
Figure 9J:
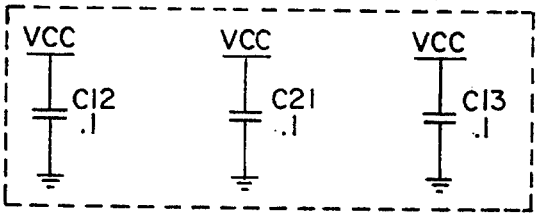
Figure 9K:
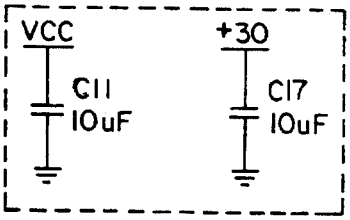

Coding means electronically stored and responsive to the jumper means for automatic configuration of the controlling means to provide control signals responsive to the input and output requirements of the sewing machine are preferably carried out by the use of an EPROM as describe above. However, it is to be understood that the coding means such as those including the use of a microprocessor could equally be used. However, the EPROM provides cost effective advantages as well as not being as susceptible to electromagnetic forces present near sewing machine motors. The flowchart shown in FIG. 8 illustrates the steps carried out by the EPROM in connection with the jumper and coding means. These steps are also applicable to other coding means.

In summary, the jumper means for programming a particular configuration of input and output requirements responsive to the sewing machine includes a control cable connector or 25 pin subminature D connector which has a plurality of pins. The pins being electronically responsive to the input and output requirements. A control cable is constructed having a predetermined set of wire leads. The wire leads having first lead ends and a second lead ends. The first ends being electronically connectable with the motor of the sewing machine, and the second ends being electronically connectable with a predetermined set of pins.

The output DO thru D7 of the EPROM U5 are connected as follows: D0–D3 are connected to logic drivers U7 whose outputs interface with digital inputs of the sewing machine motor. Motors requiring only digital inputs, such as Quick-Rotan, EFKA DC, and EFKA Variostop, have these signals interface with the motor. Motors which require digital inputs for conditions simulating neutral, light reverse, and full reverse get those inputs from these interfaces. The analog speed control input for these motors comes from the part of the circuit later described; D4–D7 are connected to driver output chip U11 whose output operate up to four solenoid valves or other devices for semi-automation of a particular operation. To achieve this, solenoid processing means are provided for monitoring solenoid sensor input produced by an external device and actuating a solenoid valve in response to the solenoid sensor input, as illustrated schematically in FIG. 9.

Outputs of chip U7 are connected to the 25 pin subminature D connector. The many extra pins of this connector allow for jumper programming to select the correct function table in the EPROM for the selected sewing motor and also to properly connect the inputs and outputs of OP Amp U9 for proper analog speed outputs if needed. Additionally, these pins route proper voltages, and common lines to the proper part of the circuit.

As previously stated, some motors such as those produced by Mitsubishi, Clinton, Singer, Panasonic, and Unistop require analog speed control inputs. This is accomplished by Op Amp U2 and U9. Since some motors require increased voltage to increase speed while other require decreased voltage to decrease speed and some motors require 0–12 volt signals and other require 0–5 volt signals, the inputs and gain selection were routed to the 25 pin subminature D connector for proper programming connections.

The data needed to be programmed within the EPROM involves those motor functions particular to each type of motor. This data is readily available from the motor manufactures and can be easily programmed into the EPROM by one skilled in the electronics art. The corresponding jumpers which will call upon the appropriate data in the EPROM is predetermined and interfaced within an interconnecting control cable so that the entire apparatus and system may be used for multiple types of motors with only different control cables being required. For example, providing full functions with the use of photocells and solenoids in a full speed range for the Clinton, Singer, and Panasonic sewing machines requires the following jumpers: 3-GND, +5-VCC, P1-GND, and P3-GND. While providing these machines with two speed range requires the following jumpers: 3-X, +5-VCC, P3-GND, 4-GND, and P1-GND.

In summary, the controlling means is responsive to the monitoring means for varying the speed of the motor of the sewing machine by outputting control signals to the motor corresponding to sensor input from the force sensor and ceasing operation of the motor and applying reverse motor functions by outputting control signals to the motor corresponding to sensor input from the second force sensor.

To provide an operator with a option of having standup or sit-down operation of a sewing machine controlled within a single apparatus or system the use of a foot pedals 88, as shown in FIG. 1 may be used. The foot pedals utilize the same type of force sensor as described above. As illustrated in FIGS. 10–12, the foot pedal preferably includes a bottom portion 96 and a top portion 98 formed of plastic. A force sensor located between the bottom portion 96 and top portion 98 is actuated when an extending double D button 36 having a circular member 42 pressingly engages against the active area of the sensor when a foot of the operator is pressed upon the button 36.

In a preferred configuration, a first foot pedal having a third force sensor a second foot pedal having a fourth force sensor are provided. Means are provided for electronically interconnecting the first foot pedal and second foot pedal with the electronic means so that actuation of the third force sensor will correspond to the electronic means completed by actuation of the force sensor and actuation of the fourth force sensor will correspond to the electronic means completed by actuation of the second force sensor. This allows for operation of the sewing machine when the operator is in a standing upright position utilizing the body actuated apparatus and for operation of the sewing machine when the operator is in a sitting position utilizing the first foot pedal and second foot pedal.

Although the invention has been described by reference to some embodiments it is not intended that the novel device be limited thereby, but that modifications thereof are intended to be included as falling within the broad scope and spirit of the foregoing disclosure, the following claims and the appended drawings.

We claim:

1. An above ground level human body actuated control apparatus for use with an industrial machine by an upright standing operator while both feet are fixed in pressing engagement wit a floor surface, comprising:

(a) an elongated housing;

(b) an elongated control bar having a vertically disposed outer side which extends horizontally, the elongated control bar being sized and configured for horizontally extending across an upright body portion of the operator;

(c) means for pivotally mounting the elongated control bar to the elongated housing for generally horizontal movement of the elongated control bar relative to the elongated housing;

(d) biasing means operatively positioned between the elongated housing and the elongated control bar for urging the elongated control bar in a first direction;

(e) a force sensor operatively positioned between the elongated housing and the elongated control bar; and (f) sensor actuator means operatively positioned relative to the force sensor for co-action with the force sensor when the upright body portion of the operator pressingly engages the elongated control bar in a second direction.

2. The apparatus of claim 1, further comprising:

(a) a second elongated housing;

(b) pivoting means for pivotally connecting the second elongated housing to the elongated housing for adjustable positioning the elongated second housing relative to the elongated housing;

(c) an elongated function bar;

(d) means for pivotally mounting the elongated function bar to the second elongated housing;

(e) second biasing means operatively positioned between the second elongated housing and the elongated function bar for urging the elongated function bar in a third direction;

(f) a second force sensor operatively positioned between the second elongated housing and the elongated function bar; and (g) second sensor actuator means operatively positioned relative to the second force sensor for co-action with the second force sensor when the body of the operator pressingly engages the elongated function bar in a fourth direction.

3. The apparatus of claim 1, further comprising means for adjustably mounting the sensor actuator means so that the spaced apart relationship between the sensor actuator means and the force sensor can be varied.

4. The apparatus of claim 2, further comprising means for adjustably mounting the second sensor actuator means so that the spaced apart relationship between the second sensor actuator means and the second force sensor can be varied.

5. The apparatus of claim 2, further comprising an adjustment bar having a first end and a second end, the first end pivotally mounted to the second elongated housing, the second end having a slot for varied adjustable mounting to the elongated housing.

6. The apparatus of claim 2, further comprising electronic means for controlling the speed and reverse functions of a motor of the industrial machine which include:

(1) monitoring means for monitoring sensor input produced by the force sensor and second force sensor; and (2) controlling means responsive to the monitoring means for varying the speed of the motor of the industrial machine by outputting control signals to the motor corresponding to sensor input from the force sensor and ceasing operation of the motor and applying reverse motor functions by outputting control signals to the motor corresponding to sensor input from the second force sensor.

7. The apparatus of claim 6, wherein the electronic means includes:

(a) jumper means for programming a particular configuration of input and output requirements responsive to the industrial machine; and (a) coding means electronically stored and responsive to the jumper means for automatic configuration of the controlling means to provide control signals responsive to the input and output requirements of the industrial machine.

8. The apparatus of claim 1, wherein the elongated control bar includes a wedge shaped control bar pad mounted on the outer side of the elongated control bar for pressingly engaging a front portion of an upright body portion of the operator when the elongated control bar is pressed.

9. The apparatus of claim 2, wherein the elongated function bar includes a wedge shaped function bar pad mounted on an outer side of the elongated function bar for pressingly engaging a side portion of an upright body portion of the operator when the elongated function bar is pressed.

10. A control apparatus for controlling the operation of a sewing machine with an upright body portion of a human body by an upright standing operator while both feet are fixed in pressing engagement with a floor surface, comprising a body actuated apparatus mounted in a spaced apart relationship from ground level and in approximate adjacency to the sewing machine, the body actuated apparatus having an elongated control bar operatively mounted to the body actuated apparatus for actuation of a force sensor from generally horizontal movement of the elongated control bar relative to the body actuated apparatus when a front portion of the upright body portion of an operator pressingly engages the control bar in a direction towards the sewing machine, the elongated control bar having a vertically disposed outer side which extends horizontally, the elongated control bar being sized and configured for horizontally extending across the upright body portion of the operator, the body actuated apparatus having an elongated function bar operatively mounted to the body actuated apparatus for actuation of a second force sensor when a side portion of the upright body portion of the operator pressingly engages the elongated function bar.

11. The apparatus of claim 10, wherein the body actuated apparatus includes pivoting means for pivotally connecting the elongated function bar to the body actuated apparatus approximately 0° to 90° in planar relation to the elongated control bar for varied adjustment of the elongated function bar.

12. The apparatus of claim 11, further comprising means for securing the elongated function bar in a selected pivoted position so that the elongated function bar will remain in a predetermined position relative to the elongated control bar when the elongated function bar is pressed.

13. The apparatus of claim 10, wherein the elongated control bar includes a wedge shaped control bar pad mounted on the outer side of the elongated control bar for pressingly engaging the front portion of the upright body portion of the operator when the elongated control bar is pressed.

14. The apparatus of claim 13, wherein the elongated function bar includes a wedge shaped function bar pad mounted on an outer side of the elongated function bar for pressingly engaging the side portion of the upright body portion of the operator when the elongated function bar is pressed.

15. The apparatus of claim 14, wherein the wedge shaped control bar pad and wedge shaped function bar pad are formed of foam pad and further comprise hook and loop means for removable mounting.

16. The apparatus of claim 10, further comprising electronic means for controlling the speed and reverse functions of a motor of the sewing machine which include:

(1) monitoring means for monitoring sensor input produced by the force sensor and second force sensor; and (2) controlling means responsive to the monitoring means for varying the speed of the motor of the sewing machine by outputting control signals to the motor corresponding to sensor input from the force sensor and ceasing operation of the motor and applying reverse motor functions by outputting control signals to the motor corresponding to sensor input from the second force sensor.

17. The apparatus of claim 16, wherein the electronic means includes:

(a) jumper means having a plurality of input lines for programming a particular configuration of input and output requirements responsive to the sewing machine; and (a) coding means electronically stored and responsive to the jumper means for automatic configuration of the controlling means to provide control signals responsive to the input and output requirements of the sewing machine.

18. The apparatus of claim 16, further comprising:

(a) a first foot pedal having a third force sensor;

(b) a second foot pedal having a fourth force sensor; and (c) means for electronically interconnecting the first foot pedal and second foot pedal with the electronic means so that actuation of the third force sensor will correspond to the electronic means completed by actuation of the force sensor and actuation of the fourth force sensor will correspond to the electronic means completed by actuation of the second force sensor, allowing for operation of the sewing machine when the operator is in a standing upright position utilizing the body actuated apparatus and for operation of the sewing machine when the operator is in sitting a position utilizing the first foot pedal and second foot pedal.

19. The apparatus of claim 18, wherein the jumper means includes a control cable connector having a plurality of pins, the pins being electronically connected to the input lines, and a control cable having a predetermined set of wire leads, the wire leads having first lead ends and a second lead ends, the first ends being electronically connectable with the motor of the sewing machine, and the second ends being electronically connectable with a predetermined set of pins, the predetermined set of pins programmably corresponding to a set of input lines coupled with the coding means to automatically configure the input and output requirements responsive to the sewing machine.

20. An electronic control system for controlling the operation of an industrial machine by an upright standing operator while both feet are fixed in pressing engagement with a floor surface, comprising:

(a) a body actuated apparatus mounted in a spaced apart relationship from ground level and in approximate adjacency to the industrial machine, the body actuated apparatus having an elongated control bar pivotally mounted to the body actuated apparatus along a longitudinal axis of the elongated control bar for actuation of a force sensor from generally horizontal movement of the elongated control bar relative to the body actuated apparatus when a front portion of a body of an upright standing operator pressingly engages the elongated control bar in a direction towards the industrial machine, the elongated control bar having a vertically disposed outer side which extends horizontally, the elongated control bar being sized and configured for horizontally extending across an upright body portion of the operator; and (b) electronic means for controlling the speed of a motor of the industrial machine which include:

(1) monitoring means for monitoring sensor input produced by the force sensor; and (2) controlling means responsive to the monitoring means for varying the speed of the motor of the industrial machine by outputting control signals to the motor.

21. The system of claim 20, wherein the electronic means includes:

(a) jumper means having a plurality of input lines for programming a particular configuration of input and output requirements responsive to the industrial machine; and (a) coding means electronically stored and responsive to the jumper means for automatic configuration of the controlling means to provide control signals responsive to the input and output requirements of the industrial machine.

22. The system of claim 20, wherein the electronic means includes means for adjusting the sensitivity of the monitoring means so that an amount of force necessary to actuate the force sensor can be varied.

23. The system of claim 20, wherein the controlling means includes means for adjusting a maximum speed of the motor attainable when the sensor input of the monitoring means signals full actuation of the force sensor.

24. The system of claim 21, wherein the jumper means includes a control cable connector having a plurality of pins, the pins being electronically connected to the input lines, and a control cable having a predetermined set of wire leads, the wire leads having first lead ends and a second lead ends, the first ends being electronically connectable with the motor of the industrial machine, and the second ends being electronically connectable with a predetermined set of pins, the predetermined set of pins programmably corresponding to a set of input lines coupled with the coding means to automatically configure the input and output requirements responsive to the sewing machine.

25. The system of claim 20, wherein the electronic means includes photocell processing means for monitoring a photocell sensor input produced by a photocell and controlling the speed of the motor in response to the photocell sensor input.

26. The system of claim 25, wherein the photocell processing means includes timer means for calculating a period of time delay before the controlling means should cease operation of the motor based upon corresponding photocell sensor input.

27. The system of claim 26, wherein the photocell processing means includes means for adjusting the period of time delay calculated by the timer means.

28. The system of claim 20, wherein the electronic means includes solenoid processing means for monitoring solenoid sensor input produced by an external device and actuating a solenoid valve in response to the solenoid sensor input.

29. An electronic control system for controlling the operation of a sewing machine with the upright center portion of a human body by an upright standing operator, comprising:

(a) a body actuated apparatus mounted in a spaced apart relationship from ground level and in approximate adjacency to the industrial machine, the body actuated apparatus having an elongated control bar pivotally mounted to the body actuated apparatus along a longitudinal axis of the elongated control bar for actuation of a force sensor from generally horizontal movement of the elongated control bar relative to the body actuated apparatus when a front portion of the upright center portion of the body of an operator pressingly engages the control bar in a direction towards the industrial machine, the elongated control bar having a vertically disposed outer side which extends horizontally, the elongated control bar being sized and configured for horizontally extending across the upright body portion of the operator, the body actuated apparatus having an elongated function bar pivotally mounted to the body actuated apparatus for actuation of a second force sensor when a side portion of the upright center portion of the body of an operator pressingly engages the elongated function bar, the body actuated apparatus having pivoting means for pivotally connecting the elongated function bar to the body actuated apparatus in angled planar relation to the elongated control bar for varied adjustment of the elongated function bar; and (b) electronic means for controlling the speed and reverse functions of a motor of the sewing machine which include:

(1) monitoring means for monitoring sensor input produced by the force sensor and second force sensor; and (2) controlling means responsive to the monitoring means for varying the speed of the motor of the sewing machine by outputting control signals to the motor corresponding to sensor input from the force sensor and ceasing operation of the motor and applying reverse motor functions by outputting control signals to the motor corresponding to sensor input from the second force sensor.

30. The system of claim 29, wherein the electronic means includes:

(a) jumper means having a plurality of input lines for programming a particular configuration of input and output requirements responsive to the sewing machine; and (a) coding means electronically stored and responsive to the jumper means for automatic configuration of the controlling means to provide control signals responsive to the input and output requirements of the sewing machine.

31. The system of claim 29, wherein the electronic means includes means for adjusting the sensitivity of the monitoring means so that an amount of force necessary to actuate the force sensor can be varied.

32. The system of claim 29, wherein the controlling means includes means for adjusting a maximum speed of the motor attainable when the sensor input of the monitoring means signals full actuation of the force sensor.

33. The system of claim 30, wherein the jumper means includes a control cable connector having a plurality of pins, the pins being electronically connected to the input lines, and a control cable having a predetermined set of wire leads, the wire leads having first lead ends and a second lead ends, the first ends being electronically connectable with the motor of the sewing machine, and the second ends being electronically connectable with a predetermined set of pins, the predetermined set of pins programmably corresponding to a set of input lines coupled with the coding means to automatically configure the input and output requirements responsive to the sewing machine.

34. The system of claim 29, wherein the electronic means includes photocell processing means for monitoring a photocell sensor input produced by a photocell and controlling the speed of the motor in response to the photocell sensor input.

35. The system of claim 34, wherein the photocell processing means includes timer means for calculating a period of time delay before the controlling means should cease operation of the motor based upon corresponding photocell sensor input.

36. The system of claim 35, wherein the photocell processing means includes means for adjusting the period of time delay calculated by the timer means.

37. The system of claim 29, wherein the electronic means includes solenoid processing means for monitoring solenoid sensor input produced by an external device and actuating a solenoid valve in response to the solenoid sensor input.

38. The system of claim 29, further comprising:

(a) a first foot pedal having a third force sensor;

(b) a second foot pedal having a fourth force sensor; and (c) means for electronically interconnecting the first foot pedal and second foot pedal with the electronic means so that actuation of the third force sensor will correspond to the electronic means completed by actuation of the force sensor and actuation of the fourth force sensor will correspond to the electronic means completed by actuation of the second force sensor, allowing for operation of the sewing machine when the operator is in a standing upright position utilizing the body actuated apparatus and for operation of the sewing machine when the operator is in a sitting position utilizing the first foot pedal and second foot pedal.

39. The system of claim 29, wherein the elongated control bar includes a wedge shaped control bar pad mounted on the outer side of the elongated control bar for pressingly engaging the front portion of the upright center portion of the operator when the elongated control bar is pressed, and the elongated function bar includes a wedge shaped function bar pad mounted on an outer side of the elongated function bar for pressingly engaging the side portion of the upright center portion of the operator when the elongated function bar is pressed.

40. An electronic control system for use with force sensors to control speed and reverse operational functions of a motor of a sewing machine, comprising:

(a) monitoring means for monitoring sensor input produced by a force sensor and a second force sensor;

(b) controlling means responsive to the monitoring means for varying the speed of the motor of the sewing machine by outputting control signals to the motor corresponding to sensor input from the force sensor and ceasing operation of the motor and applying reverse motor functions by outputting control signals to the motor corresponding to sensor input from the second force sensor;

(c) jumper means having a plurality of input lines for programming a particular configuration of input and output requirements responsive to the sewing machine, the jumper means having cable means electrically connectable with a set of input lines which are programmably selected for operative interconnection with the sewing machine; and (d) coding means electronically stored and responsive to the jumper means for automatic configuration of the controlling means to provide control signals responsive to the input and output requirements of the sewing machine.

41. The system of claim 40, wherein the electronic means includes means for adjusting the sensitivity of the monitoring means so that an amount of force necessary to actuate the force sensor can be varied.

42. The system of claim 40, wherein the controlling means includes means for adjusting a maximum speed of the motor attainable when the sensor input of the monitoring means signals full actuation of the force sensor.

43. The system of claim 40, wherein the jumper means includes a control cable connector having a plurality of pins, the pins being electronically connected to the input lines, and a control cable having a predetermined set of wire leads, the wire leads having first lead ends and a second lead ends, the first ends being electronically connectable with the motor of the sewing machine, and the second ends being electronically connectable with a predetermined set of pins, the predetermined set of pins programmably corresponding to a set of input lines coupled with the coding means to automatically configure the input and output requirements responsive to the sewing machine.

44. The system of claim 40, further comprising photocell processing means for monitoring a photocell sensor input produced by a photocell and controlling the speed of the motor in response to the photocell sensor input.

45. The system of claim 44, wherein the photocell processing means includes timer means for calculating a period of time delay before the controlling means should cease operation of the motor based upon corresponding photocell sensor input.

46. The system of claim 45, wherein the photocell processing means includes means for adjusting the period of time delay calculated by the timer means.

47. The system of claim 40, wherein the electronic means includes solenoid processing means for monitoring solenoid sensor input produced by an external device and actuating a solenoid valve in response to the solenoid sensor input.

48. The system of claim 40, further comprising means for electronically interconnecting a first foot pedal and a second foot pedal with the controlling means so that actuation of a third force sensor of the first foot pedal will correspond to the controlling means completed by actuation of the force sensor and actuation of a fourth force sensor of the second foot pedal will correspond to the electronic means completed by actuation of the second force sensor, allowing for operation of the sewing machine with two separate sets of force sensors.

49. A control apparatus for controlling the operation of a sewing machine with an upright body portion of a human body, comprising a body actuated apparatus mounted in a spaced apart relationship from ground level and in approximate adjacency to the sewing machine, the body actuated apparatus having an elongated control bar pivotally mounted to the body actuated apparatus along a longitudinal axis of the elongated control bar for actuation of a force sensor when a front portion of the upright body portion of an operator pressingly engages the control bar in a direction towards the sewing machine, the body actuated apparatus having an elongated function bar pivotally mounted to the body actuated apparatus along longitudinal axis of the elongated function bar for actuation of a second force sensor when a side portion of the upright body portion of the operator pressingly engages the elongated function bar, electronic means for controlling the speed and reverse functions of a motor of the sewing machine which include monitoring means for monitoring sensor input produced by the force sensor and second force sensor and controlling means responsive to the monitoring means for varying the speed of the motor of the sewing machine by outputting control signals to the motor corresponding to sensor input from the force sensor and ceasing operation of the motor and applying reverse motor functions by outputting control signals to the motor corresponding to sensor input from the second force sensor, a first foot pedal having a third force sensor, a second foot pedal having a fourth force sensor, and means for electronically interconnecting the first foot pedal and second foot pedal with the electronic means so that actuation of the third force sensor will correspond to the electronic means completed by actuation of the force sensor and actuation of the fourth force sensor will correspond to the electronic means completed by actuation of the second force sensor, allowing for operation of the sewing machine when the operator is in a standing upright position utilizing the body actuated apparatus and for operation of the sewing machine when the operator is in sitting a position utilizing the first foot pedal and second foot pedal.

50. An electronic control system for controlling the operation of an industrial machine, comprising:

(a) a body actuated apparatus mounted in a spaced apart relationship from ground level and in approximate adjacency to the industrial machine, the body actuated apparatus having an elongated control bar pivotally mounted to the body actuated apparatus along a longitudinal axis of the elongated control bar for actuation of a force sensor when a body of an operator pressingly engages the elongated control bar in a direction towards the industrial machine; and (b) electronic means for controlling the speed of a motor of the industrial machine which include:

(1) monitoring means for monitoring sensor input produced by the force sensor;

(2) controlling means responsive to the monitoring means for varying the speed of the motor of the industrial machine by outputting control signals to the motor; and (3) photocell processing means for monitoring a photocell sensor input produced by a photocell and controlling the speed of the motor in response to the photocell sensor input, the photocell processing means having timer means for calculating a period of time delay before the controlling means should cease operation of the motor based upon corresponding photocell sensor input.

51. The system of claim 50, wherein the photocell processing means includes means for adjusting the period of time delay calculated by the timer means.

52. The system of claim 50, wherein the electronic means includes solenoid processing means for monitoring solenoid sensor input produced by an external device and actuating a solenoid valve in response to the solenoid sensor input.

53. An electronic control system for use with force sensors to control speed and reverse operational functions of a motor of a sewing machine, comprising:

(a) monitoring means for monitoring sensor input produced by a force sensor and a second force sensor;

(b) controlling means responsive to the monitoring means for varying the speed of the motor of the sewing machine by outputting control signals to the motor corresponding to sensor input from the force sensor and ceasing operation of the motor and applying reverse motor functions by outputting control signals to the motor corresponding to sensor input from the second force sensor;

(c) jumper means for programming a particular configuration of input and output requirements responsive to the sewing machine;

(d) coding means electronically stored and responsive to the jumper means for automatic configuration of the controlling means to provide control signals responsive to the input and output requirements of the sewing machine; and (e) photocell processing means for monitoring a photocell sensor input produced by a photocell and controlling the speed of the motor in response to the photocell sensor input, the photocell processing means having timer means for calculating a period of time delay before the controlling means should cease operation of the motor based upon corresponding photocell sensor input.

54. An electronic control system for use with force sensors to control speed and reverse operational functions of a motor of a sewing machine, comprising:

(a) monitoring means for monitoring sensor input produced by a force sensor and a second force sensor;

(b) controlling means responsive to the monitoring means for varying the speed of the motor of the sewing machine by outputting control signals to the motor corresponding to sensor input from the force sensor and ceasing operation of the motor and applying reverse motor functions by outputting control signals to the motor corresponding to sensor input from the second force sensor;

(c) jumper means for programming a particular configuration of input and output requirements responsive to the sewing machine;

(d) coding means electronically stored and responsive to the jumper means for automatic configuration of the controlling means to provide control signals responsive to the input and output requirements of the sewing machine; and (e) solenoid processing means for monitoring solenoid sensor input produced by an external device and actuating a solenoid valve in response to the solenoid sensor input.

55. An electronic control system for use with force sensors to control speed and reverse operational functions of a motor of a sewing machine, comprising:

(a) monitoring means for monitoring sensor input produced by a force sensor and a second force sensor;

(b) controlling means responsive to the monitoring means for varying the speed of the motor of the sewing machine by outputting control signals to the motor corresponding to sensor input from the force sensor and ceasing operation of the motor and applying reverse motor functions by outputting control signals to the motor corresponding to sensor input from the second force sensor;

(c) jumper means for programming a particular configuration of input and output requirements responsive to the sewing machine;

(d) coding means electronically stored and responsive to the jumper means for automatic configuration of the controlling means to provide control signals responsive to the input and output requirements of the sewing machine; and (e) means for electronically interconnecting a first foot pedal and a second foot pedal with the controlling means so that actuation of a third force sensor of the first foot pedal will correspond to the controlling means completed by actuation of the force sensor and actuation of a fourth force sensor of the second foot pedal will correspond to the electronic means completed by actuation of the second force sensor, allowing for operation of the sewing machine with two separate sets of force sensors.

56. A control apparatus for controlling the operation of a sewing machine with an upright body portion of an upright standing operator while the operator simultaneously has both feet fixed in pressing engagement with a floor surface, comprising a body actuated apparatus mounted in a spaced apart relationship from ground level at a height above the operators knees and in approximate adjacency to the sewing machine, the body actuated apparatus having an elongated control bar, the elongated control bar having mounting means for operatively mounting the elongated control bar to the body actuated apparatus for generally horizontal movement of the elongated control bar relative to the body actuated apparatus when a front portion of the upright body portion of an operator leans forward while maintaining both feet in fixed position with the floor surface to pressingly engage the control bar in a direction towards the sewing machine, a force sensor operatively mounted to the body actuated apparatus for actuation by the elongated control bar to control the sewing machine, the elongated control bar having a vertically disposed outer side which extends horizontally, the elongated control bar being sized and configured for horizontally extending across and engagement with the upright body portion of the operator.

* * * * *